US011718503B2

(12) United States Patent
Kattainen et al.

(10) Patent No.: US 11,718,503 B2
(45) Date of Patent: Aug. 8, 2023

(54) ELEVATOR SYSTEM

(71) Applicant: Kone Corporation, Helsinki (FI)

(72) Inventors: Ari Kattainen, Helsinki (FI); Jari Kantola, Helsinki (FI)

(73) Assignee: Kone Corporation, Helsinki (FI)

( * ) Notice: Subject to any disclaimer, the term of this patent is extended or adjusted under 35 U.S.C. 154(b) by 508 days.

(21) Appl. No.: 16/458,837

(22) Filed: Jul. 1, 2019

(65) Prior Publication Data

US 2020/0071128 A1 Mar. 5, 2020

(30) Foreign Application Priority Data

Aug. 31, 2018 (EP) ..... 18191950

(51) Int. Cl.

| | |
|---|---|
| ***B66B 5/04*** | (2006.01) |
| ***B66B 5/00*** | (2006.01) |
| ***B66B 5/16*** | (2006.01) |

(52) U.S. Cl.

CPC ..... *B66B 5/04* (2013.01); *B66B 5/0031* (2013.01); *B66B 5/0093* (2013.01); *B66B 5/16* (2013.01)

(58) Field of Classification Search

CPC ..... B66B 5/04; B66B 5/0031; B66B 13/285; B66B 11/0233; B66B 5/0056; B66B 5/02; B66B 5/0093; B66B 5/16; B66B 1/32

See application file for complete search history.

(56) References Cited

U.S. PATENT DOCUMENTS

| | | | | |
|---|---|---|---|---|
| 5,476,157 | A * | 12/1995 | Todaro | B66B 13/24 187/280 |
| 6,173,813 | B1 * | 1/2001 | Rebillard | B66B 5/06 187/287 |
| 7,178,635 | B2 * | 2/2007 | Meissner | B66B 11/0095 187/249 |
| 7,650,969 | B2 * | 1/2010 | Monzon | B66B 5/06 187/300 |
| 8,136,637 | B2 * | 3/2012 | Coquerelle | B66B 5/18 187/391 |

(Continued)

FOREIGN PATENT DOCUMENTS

WO WO-2017/203558 A1 11/2017

OTHER PUBLICATIONS

European Search Report for European Patent Application No. EP18191950 dated Apr. 23, 2019.

(Continued)

*Primary Examiner* — Michael R Mansen
*Assistant Examiner* — Michelle M Lantrip
(74) *Attorney, Agent, or Firm* — Harness, Dickey & Pierce, P.L.C.

(57) ABSTRACT

According to an aspect, there is provided an elevator system comprising an elevator car configured to move in an elevator shaft; a main safety controller comprising a main safety output and a secondary safety output, wherein the main safety output is configured to control machinery brakes of the elevator car; and a secondary safety circuit connected to the secondary safety output and arranged in the elevator car and comprising at least one safety contact configured to control stopping means arranged in the elevator car; wherein when the at least one safety contact is triggered the secondary safety circuit is configured to control the stopping means to cause stopping of the elevator car.

12 Claims, 5 Drawing Sheets

(56) References Cited

U.S. PATENT DOCUMENTS

| | | | | |
|---|---|---|---|---|
| 8,820,482 | B2 * | 9/2014 | De Coi | B66B 5/0031 187/247 |
| 2011/0088983 | A1 | 4/2011 | Sirigu et al. | |
| 2013/0118836 | A1 | 5/2013 | Rossignol | |
| 2016/0325964 | A1 * | 11/2016 | Haapaniemi | B66B 5/22 |
| 2018/0186600 | A1 * | 7/2018 | Kramer | B66B 1/30 |
| 2019/0077633 | A1 * | 3/2019 | Shibata | B66B 5/005 |

OTHER PUBLICATIONS

Chinese Office Action dated Mar. 24, 2022 by the Patent Office of China for corresponding application CN No. 2019106896260.

* cited by examiner

ELEVATOR SYSTEM

This application claims priority to European Patent Application No. EP-18191950.7 filed on Aug. 31, 2018, the entire contents of which are incorporated herein by reference.

BACKGROUND

Safety is an important factor in elevator systems. These systems may comprise a number of safety devices providing signals for a controlling unit, for example, a safety circuit board. The controlling unit then determines whether operation of an elevator car is possible.

When performing maintenance operations, a serviceman may override the safety circuit intentionally or unintentionally. The safety circuit may also become short-circuited, for example, by dirt in shaft electronics or wear of a traveling cable, leaving safety measures in the shaft completely inoperable. This is a critical safety issue especially in elevators With elevator shafts having low/no headroom or pit, according to regulations there has to be a device limiting the elevator car travel, normally activated when the safety circuit is in the inspection mode. However, it may be possible that the device limiting the elevator car travel has also been short-circuited.

Thus, it would be beneficial to have a solution that would alleviate at least one of these drawbacks.

SUMMARY

According to at least some of the aspects, a solution is provided that enables stopping an elevator car even if all electrically controlled stopping devices have become non-operational.

According to a first aspect of the invention, there is provided an elevator system comprising an elevator car configured to move in an elevator shaft; a main safety controller comprising a main safety output and a secondary safety output, wherein the main safety output is configured to control machinery brakes of the elevator car; and a secondary safety circuit connected to the secondary safety output and arranged in the elevator car and comprising at least one safety contact configured to control stopping means arranged in the elevator car. When the at least one safety contact is triggered the secondary safety circuit is configured to control the stopping means to cause stopping of the elevator car.

In an embodiment, the stopping means comprises a solenoid, an engagement mechanism and a safety gear, wherein in response to triggering the at least one contact, the solenoid is configured to cause the engagement mechanism to move to a position enabling contact with a triggering device in the elevator shaft, the triggering device in turn causing activation of the safety gear.

In an embodiment, the main safety controller comprises a first input connected to the solenoid, wherein the main safety controller is configured test the operation of the solenoid by switching off the secondary safety output and determining whether feedback information is received from the solenoid at the first input.

In an embodiment, the main safety controller is configured to test the operation of the solenoid at each stop of the elevator car.

In an embodiment, the main safety controller is configured to test the operation of the solenoid when testing the operation of the machinery brakes of the elevator car.

In an embodiment, alternatively on in addition, the at least one safety contact may include at least one balustrade contact.

In an embodiment, alternatively on in addition, the main safety controller comprises a second input connected to the at least one balustrade contact, wherein the main safety controller is configured to receive a signal at the second input when the at least one balustrade contact is triggered.

In an embodiment, alternatively on in addition, the at least one safety contact comprises an ascending car overspeed protection contact.

In an embodiment, alternatively on in addition, the at least one safety contact comprises a safety light curtain configured to be triggered when detecting an obstacle under the elevator car.

In an embodiment, alternatively on in addition, the at least one safety contact comprises at least one pressure sensor on the roof of the elevator car.

BRIEF DESCRIPTION OF THE DRAWINGS

The accompanying drawings, which are included to provide a further understanding of the invention and constitute a part of this specification, illustrate embodiments of the invention and together with the description help to explain the principles of the invention. In the drawings.

DETAILED DESCRIPTION

In the following a solution is provided in which a secondary safety circuit separate from a first safety circuit associated with machinery brakes of an elevator car is provided for securing a safety space when the roof of an elevator car or a shaft pit is occupied.

Figure 1A:
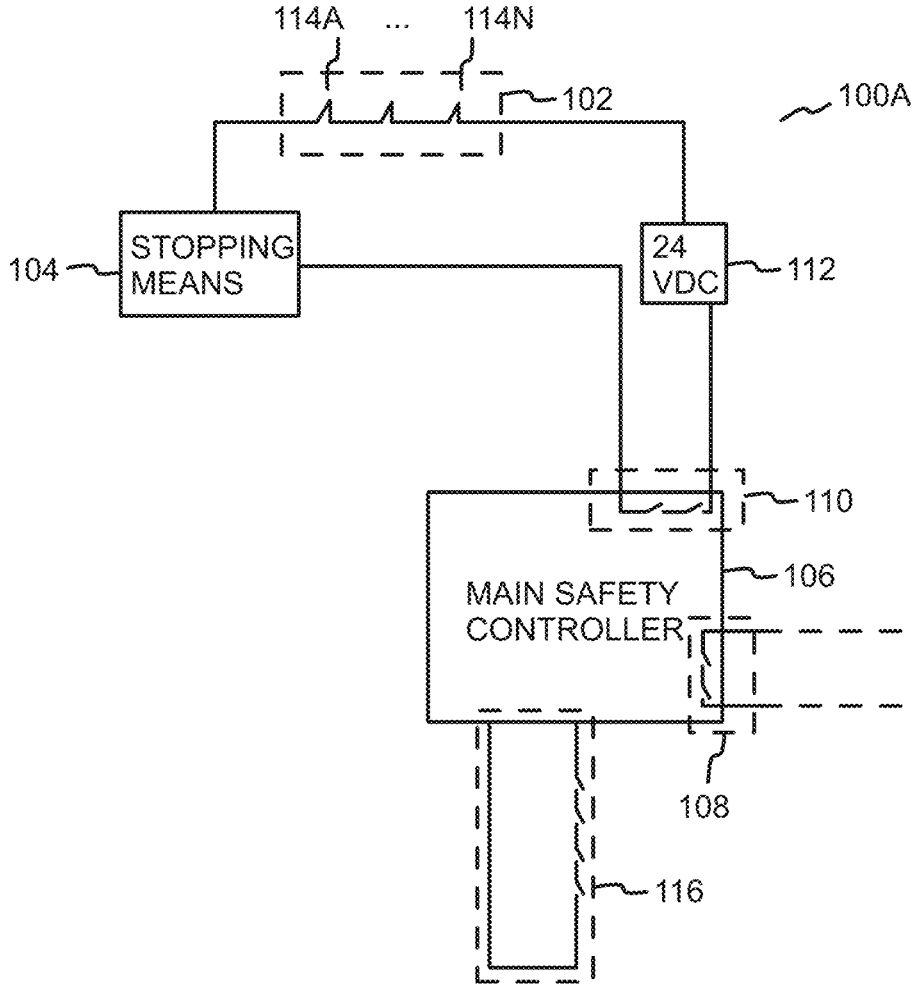
FIG. 1A illustrates a block diagram of an elevator system according to an aspect.

FIG. 1A illustrates a block diagram of an elevator system 100A according to an aspect. The elevator system 100A comprises a main safety controller 106 configured to control safety operations of the elevator system 100A comprising at least one elevator car. The main safety controller 106 is configured to monitor a status of a first safety circuit 116, and if there are no issues with the first safety circuit 116, the main safety controller 106 controls via a main safety output 108 power supply to the machinery and/or machinery brakes of the elevator. The safety circuit 116 may comprise a plurality of switches that monitor the operation of various elements, such as car and landing doors, car position and overspeed governor, in the elevator system.

In addition to the first safety circuit, the elevator system 100A comprises a secondary safety circuit 102. The secondary safety circuit 102 is connected to a secondary safety output 110 of the main safety controller 106 and arranged in the elevator car. A power source 112 may be provided to provide power to the secondary safety circuit 102. The secondary safety circuit 102 comprises at least one safety contact 114A . . . 114N configured to control stopping means 104 arranged in the elevator car. In an example, regardless of the status of the main safety circuit 106 or the machinery brakes, the secondary safety circuit 102 is able to cause stopping of the elevator car. When the at least one safety contact 114A . . . 114N is triggered, the secondary safety circuit 102 is configured to control the stopping means 104 to cause stopping of the elevator car.

Figure 4:
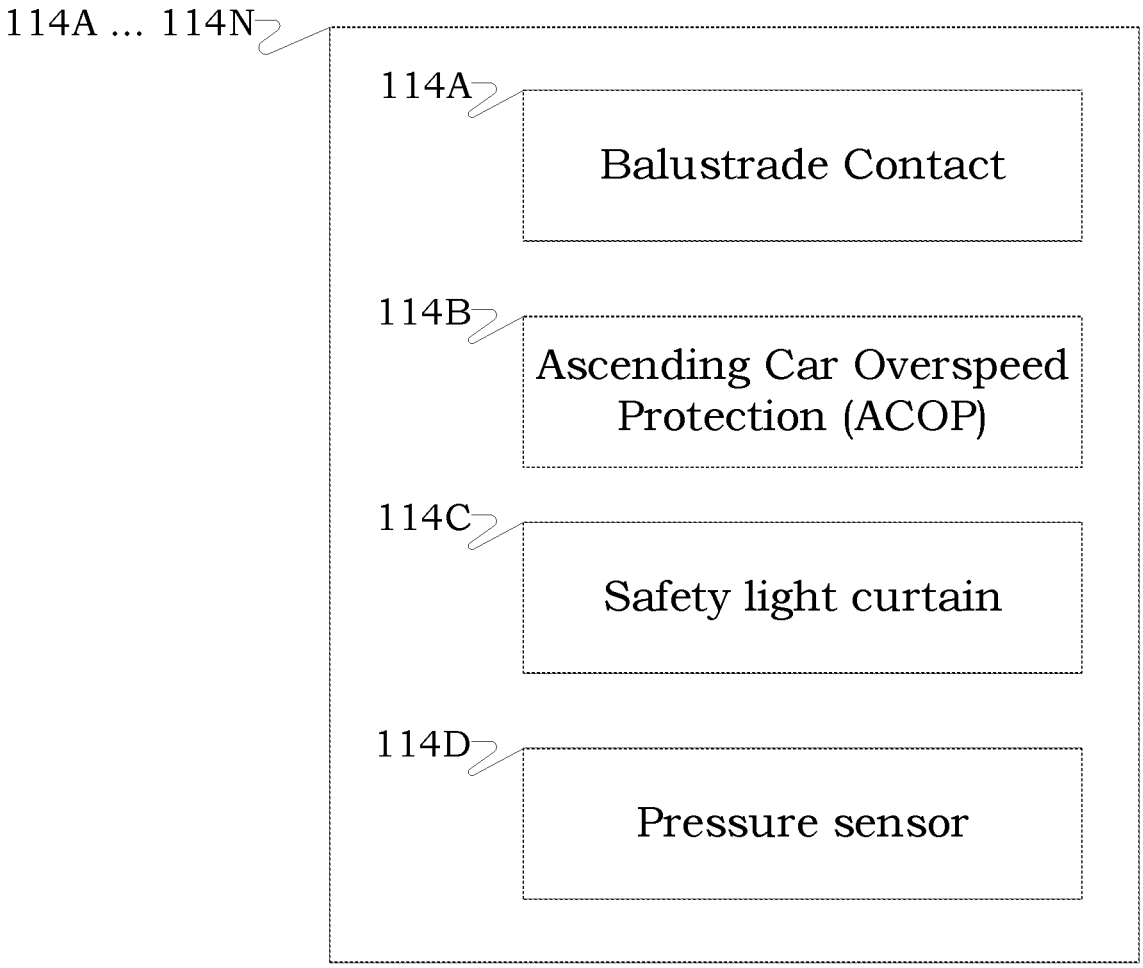
FIG. 4 illustrates examples of the at least one safety contact according to an embodiment.

Referring to FIG. 4, the at least one safety contact 114A . . . 114N may comprise different types of elements. For example, the at least one safety contact 114A . . . 114N may be a safety contact 114A related to one or more balustrades, an ascending car overspeed protection contact 114B, a safety light curtain 114C or at least one pressure sensor 114D.

As an example of possible safety contacts, the at least one safety contact 114A . . . 114N may be the safety contact 114A that is at least one switch related to one or more balustrades arranged on the roof of the elevator car. When the balustrade is moved from its resting position either upwards (as in setting it up) or downwards (as when a person is standing on a folded-down balustrade), this is detected, for example, by the at least one switch arranged in connection with the balustrade. As the safety contact 114A of the balustrade is a normally closed (NC) contact, the safety contact 114A opens when the balustrade is deviated from its resting position and, thus, causes a state change in the secondary safety circuit 102.

As another example of possible safety contacts, the at least one safety contact 114A . . . 114N may comprise the ascending car overspeed protection (ACOP) contact 114B associated with a specific speed limit. For example, the ascending car overspeed protection (ACOP) contact 114B may be a 115% normally closed safety contact. This means that when a specific speed limit of the elevator car is exceeded by 15%, the normally closed safety contact opens and causes a state change in the secondary safety circuit 102.

As another example of possible safety contacts, the at least one safety contact 114A . . . 114N may comprise the safety light curtain 114C configured to be triggered when detecting an obstacle under the elevator car. The safety light curtain 114C may be used to detect obstacles below the elevator car in the elevator shaft.

As another example of possible safety contacts, the at least one safety contact 114A . . . 114N may comprise at least one pressure sensor 114D on the roof of the elevator car. For example, a pressure mat may be arranged on the roof of the elevator car to detect any person present on the roof.

In an embodiment, the stopping means 104 comprises a solenoid, an engagement mechanism and a safety gear. The secondary safety circuit 102 is connected to the solenoid. Normally, when all the safety contacts 114A . . . 114N of the secondary safety circuit 102 are in their normal state, i.e. in the normally closed state, electricity flows to the solenoid and its plunger is in a retracted position. When the state of one of the safety contacts 114A . . . 114N changes, the electricity flow to the solenoid is interrupted. This causes the plunger to protrude and make contact with the engagement mechanism. The engagement mechanism in turn moves to a position that enables a contact with a triggering device located in the elevator shaft. The triggering device causes activation of the safety gear of the elevator car. The triggering device may be located close to the upper end of the elevator shaft. Thus the stopping means 104 together with the secondary safety circuit 102 and the triggering device enable creating a safety space in the elevator shaft.

Figure 1B:
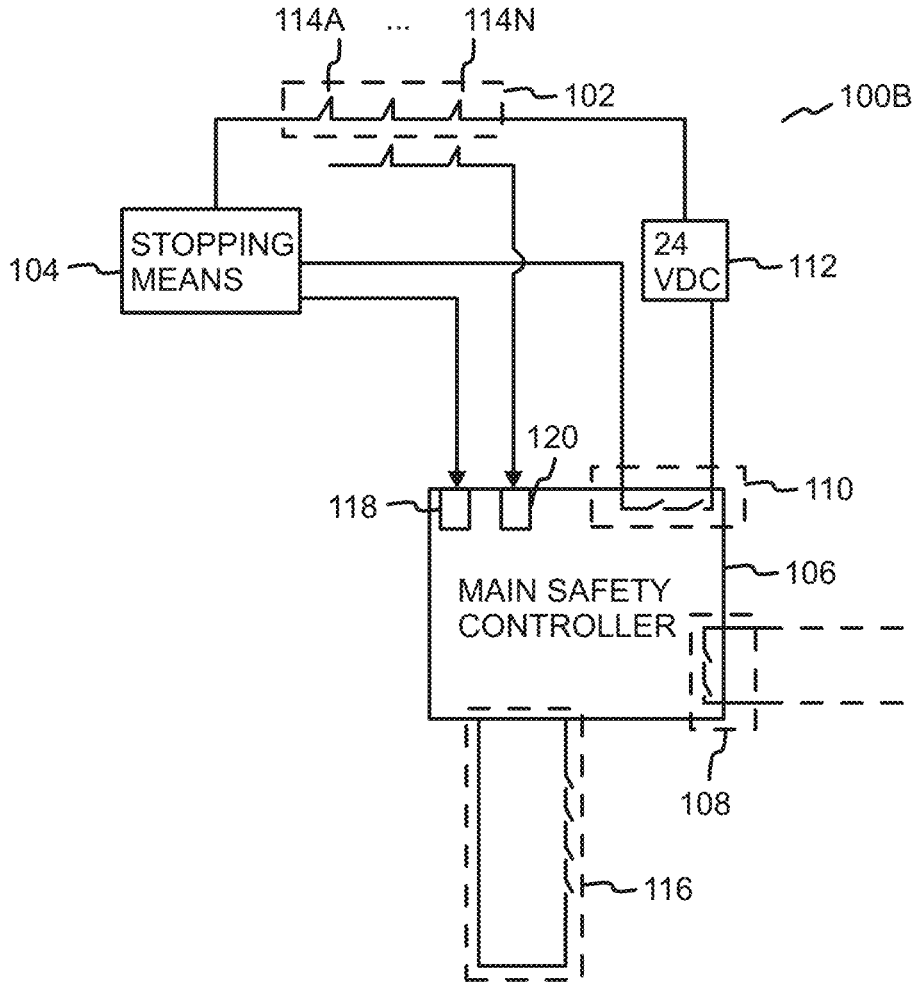
FIG. 1B illustrates a block diagram of an elevator system according to another aspect.

FIG. 1B illustrates a block diagram of an elevator system according to another aspect. The example illustrated in FIG. 1B is similar than was already illustrated in FIG. 1A, and already discussed elements are not discussed again, and reference is made to the description of FIG. 1A.

As illustrated in FIG. 1B, the elevator system 100B may additionally comprise a feedback loop from the stopping means 104 received at a first input 118 at the main safety controller 106. If the stopping means 104 comprise the earlier discussed solenoid, the main safety controller 106 may be configured to switch off the secondary safety output 110. This causes interruption of the electrical power supply to the solenoid. If the solenoid works properly, the end result should be that the plunger of the solenoid protrudes. If the solenoid is faulty, it may be that nothing happens. In any case, information about the state change of the solenoid is received at the first input 118 of the main safety controller 106. Thus, if an expected signal in response to switching off the secondary safety output 110 is not received from the solenoid, the solenoid is determined to be faulty.

When the main safety controller 106 is configured to switch off the secondary safety output 110, the main safety controller 106 may stop controlling a normally open (NO) switch or switches of the secondary safety output 110. This in turn breaks the secondary safety circuit 102, and the electrical power supply to the solenoid is interrupted, as already discussed above.

The main safety controller 106 may further include a second input 120 connected to a contact of the balustrade and configured to receive a signal from the contact of the balustrade when the at least one balustrade contact is triggered.

Figure 2:
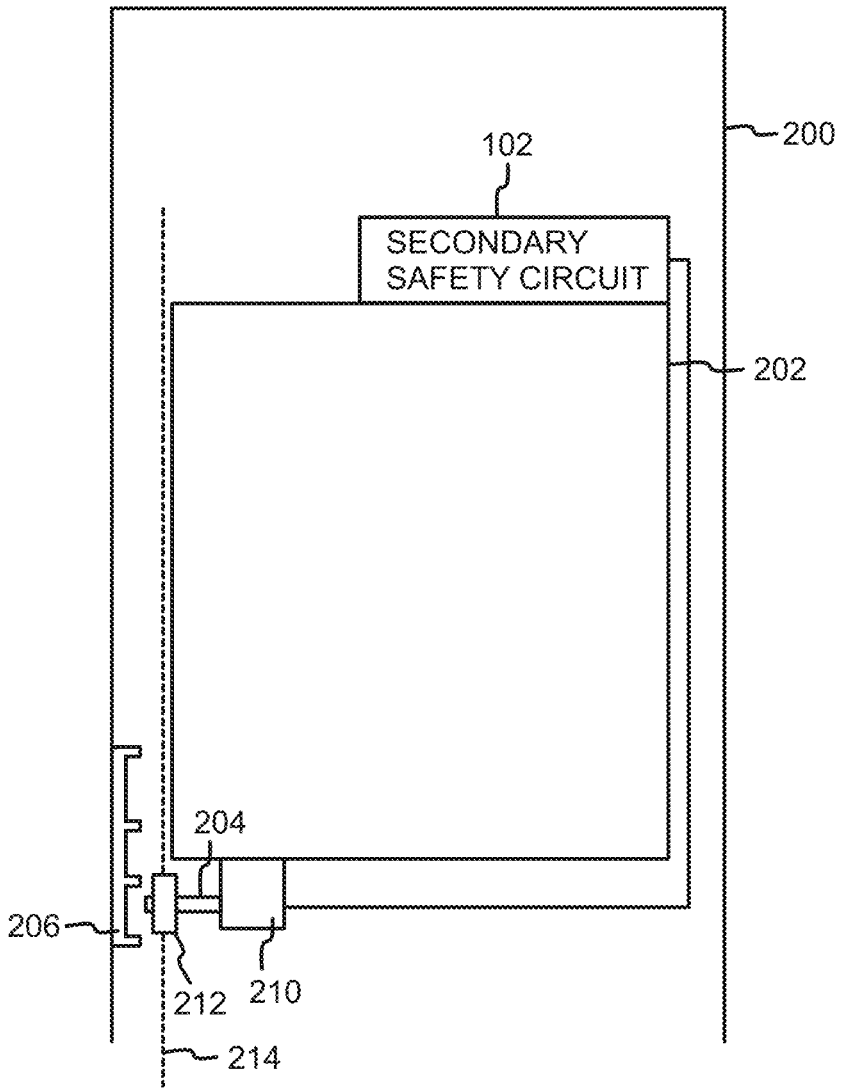
FIG. 2 illustrates an elevator car in an elevator shaft according to an embodiment.

FIG. 2 illustrates an elevator car 202 in an elevator shaft 200 according to an embodiment.

The testing of the solenoid can be performed, for example, at each stop of the elevator car. This ensures continuous monitoring of the solenoid and if the solenoid if faulty, this can be detected quickly. In another example, the testing of the solenoid is performed simultaneously when testing the operation of the machinery brakes of the elevator car. The machinery brake testing and thus also the solenoid testing, may be performed, for example, once in every 11 hours. It is evident that the testing period of the solenoid may also be any other time period, for example, one day.

FIG. 2 illustrates an elevator car 202 in an elevator shaft 200 according to an embodiment.

The secondary safety circuit 102 has been arranged in the elevator car 202. The operation of the secondary safety circuit 102 has been discussed in more detail in relation to FIGS. 1A and 1B, and therefore, this discussion is not repeated here, and reference is made to the description of FIGS. 1A and 1B. The solenoid 210 is connected to the secondary safety circuit 102.

FIG. 2 discloses a simplified illustration of how the solenoid 210 is behaving when the electricity flow to the solenoid 210 is interrupted in response to triggering at least one safety contact of the secondary safety circuit 102. This causes an engagement mechanism 204, for example, a plunger to protrude. The engagement mechanism 204, i.e. the plunger, then in turn moves to a position that will contact the triggering device 206 located in the elevator shaft 200 when the elevator car 202 moves upwards in the elevator shaft 200. When the engagement mechanism 204 contacts the triggering device 206 and when the elevator car 202 continues to move upwards in the elevator shaft, the triggering device 206 prevents the engagement mechanism 204 to move freely with the elevator car 202. This in turn prevents a speed limiting rope 214 to move freely with the elevator car 202, causing a safety gear 302 included in a safety device 212 of the elevator car 202 to tighten to a guide rail in the elevator shaft, eventually stopping the elevator car 202. Thus, by using the secondary safety circuit and the solenoid and depending on the position of the triggering device 206 in the elevator, a safety space having a desired size can be created in the elevator shaft 200. Although FIG. 2 illustrates one exemplary form for the triggering device 206, it is evident that the triggering device 206 may take any other appropriate form that is able to cooperate with the plunger 204.

Figure 3:
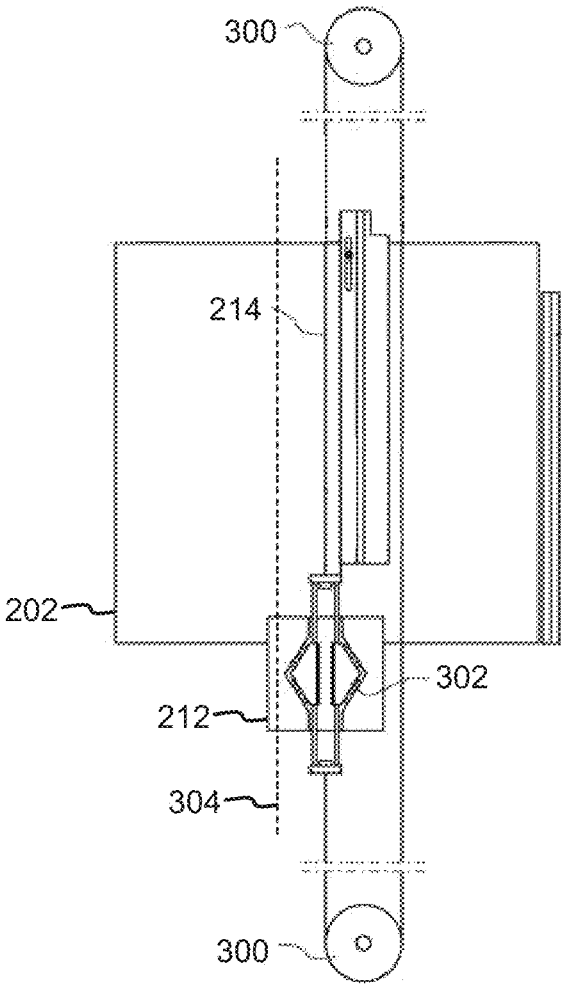
FIG. 3 illustrates an elevator car in an elevator shaft according to another embodiment.

FIG. 3 illustrates an elevator car 202 in an elevator shaft according to another embodiment. FIG. 3 discloses a different view of the arrangement illustrated in FIG. 2. The elevator car 202 is configured to move in the elevator shaft. It is evident that FIG. 3 may not necessarily disclose all elements present in the elevator shaft.

When the elevator car moves in the elevator shaft, the speed limiting rope 214 moves together with the elevator car 202. Diverting pulleys 300 may be used at each end of the elevator shaft in connection with the speed limiting rope 214. When the electricity flow to the solenoid 210 is interrupted, this causes an engagement mechanism 204, for example, a plunger to protrude. The engagement mechanism 204, i.e. the plunger, then in turn moves to a position that will contact the triggering device 206 located in the elevator shaft 200 when the elevator car 202 moves upwards in the elevator shaft 200. When the engagement mechanism 204 contacts the triggering device 206 and when the elevator car 202 continues to move upwards in the elevator shaft, the triggering device 206 prevents the engagement mechanism 204 to move freely with the elevator car 202. This in turn prevents the speed limiting rope 214 to move freely with the elevator car 202, causing a safety gear 302 of the elevator car 202 to tighten to a guide rail 304 in the elevator shaft, eventually stopping the elevator car 202.

One or more of the above embodiments may provide at least one of the following benefits. As the disclosed solution provides a mechanical solution for stopping the elevator car, the solution works even if the elevator car approaches an end of the elevator shaft during a power failure. Further, if the first safety circuit is short-circuited, this does not have any effect on the operation of the secondary safety circuit. Further, even if it happens that the secondary safety circuit is short-circuited, this will be realized when testing the solenoid. Further, it is not possible to perform the short-circuiting of the secondary safety circuit from a maintenance access panel as the wiring associated with the solenoid and the at least one safety contact is in the elevator car.

Example embodiments may be implemented in software, hardware, application logic or a combination of software, hardware and application logic. The example embodiments can store information relating to various methods described herein. This information can be stored in one or more memories, such as a hard disk, optical disk, magneto-optical disk, RAM, and the like. One or more databases can store the information used to implement the example embodiments. The databases can be organized using data structures (e.g., records, tables, arrays, fields, graphs, trees, lists, and the like) included in one or more memories or storage devices listed herein.

All or a portion of the example embodiments can be conveniently implemented using one or more general purpose processors, microprocessors, digital signal processors, micro-controllers, and the like, programmed according to the teachings of the example embodiments, as will be appreciated by those skilled in the computer and/or software art(s). Stored on any one or on a combination of computer readable media, the examples can include software for controlling the components of the example embodiments, for driving the components of the example embodiments, for enabling the components of the example embodiments to interact with a human user, and the like. Such computer readable media further can include a computer program for performing all or a portion (if processing is distributed) of the processing performed in implementing the example embodiments. In the context of this document, a "computer-readable medium" may be any media or means that can contain, store, communicate, propagate or transport the instructions for use by or in connection with an instruction execution system, apparatus, or device, such as a computer. A computer-readable medium may include a computer-readable storage medium that may be any media or means that can contain or store the instructions for use by or in connection with an instruction execution system, apparatus, or device, such as a computer. A computer readable medium can include any suitable medium that participates in providing instructions to a processor for execution. Such a medium can take many forms, including but not limited to, non-volatile media, volatile media, transmission media, and the like.

The applicant hereby discloses in isolation each individual feature described herein and any combination of two or more such features, to the extent that such features or combinations are capable of being carried out based on the present specification as a whole, in the light of the common general knowledge of a person skilled in the art, irrespective of whether such features or combinations of features solve any problems disclosed herein, and without limitation to the scope of the claims. The applicant indicates that the disclosed aspects/embodiments may consist of any such individual feature or combination of features. In view of the foregoing description it will be evident to a person skilled in the art that various modifications may be made within the scope of the disclosure.

The invention claimed is:

1. An elevator system comprising:

an elevator car configured to move in an elevator shaft;

a first safety circuit;

a main safety controller including a main safety output and a secondary safety output, wherein the main safety output is configured to selectively electrically stop the elevator car by disconnecting a power supply to machinery brakes of the elevator car based on the first safety circuit to cause the machinery brakes to engage and stop the elevator car;

a stopping device arranged at the elevator car, the stopping device including a solenoid, an engagement mechanism attached to the elevator car and a safety gear, the safety gear configured to activate and tighten to a guide rail in response to a speed limiting rope being inhibited from moving together with the elevator car when the engagement mechanism attached to the elevator car contacts a triggering device located at a fixed position in the elevator shaft; and a secondary safety circuit connected to the secondary safety output and arranged in the elevator car, the secondary safety circuit including at least one safety contact electrically connected between a power source and the solenoid via wiring, the at least one safety contact configured to mechanically stop the elevator car without disconnecting the power supply associated with the machinery brakes from providing power thereto by instructing the solenoid to cause the engagement mechanism of the stopping device to move to a position enabling the engagement mechanism to contact the triggering device to cause the triggering device to inhibit the speed limiting rope from moving with the elevator car to cause the safety gear to activate and tighten to the guide rail, when the at least one safety contact is triggered.

2. The elevator system of claim 1, wherein the main safety controller comprises:

a first input connected to the solenoid, wherein the main safety controller is configured to test an operation of the solenoid by switching off the secondary safety output and determining whether feedback information is received from the solenoid at the first input.

3. The elevator system of claim 2, wherein the main safety controller is configured to test the operation of the solenoid at each stop of the elevator car.

4. The elevator system of claim 2, wherein the main safety controller is configured to test the operation of the solenoid when testing the operation of the machinery brakes of the elevator car.

5. The elevator system of claim 1, wherein the at least one safety contact includes a balustrade contact.

6. The elevator system of claim 5, wherein main safety controller comprises:

a second input connected to the balustrade contact, wherein the main safety controller is configured to receive a signal at the second input when the balustrade contact is triggered.

7. The elevator system of claim 1, wherein the at least one safety contact comprises:

an ascending car overspeed protection contact configured to trigger in response to a speed of the elevator car exceeding a limit.

8. The elevator system of claim 1, wherein the at least one safety contact comprises:

a safety light curtain configured to trigger in response to detecting an obstacle under the elevator car.

9. The elevator system of claim 1, wherein the at least one safety contact comprises:

at least one pressure sensor on a roof of the elevator car, the at least one pressure sensor configured to trigger in response to a presence of a person on the roof of the elevator car.

10. The elevator system of claim 1, wherein the first safety circuit comprises a plurality of switches configured to trigger based on a position of one or more of car doors, landing doors and the elevator car.

11. The elevator system of claim 10, wherein the plurality of switches associated with the first safety circuit are configured to monitor different elements of the elevator system than the at least one safety contact.

12. The elevator system of claim 1, further comprising:

the speed limiting rope configured to move together with the elevator car wherein the wiring of the secondary safety circuit associated with the solenoid and the at least one safety contact is in the elevator car and is not accessible for short-circuiting from within a maintenance access panel.

* * * * *